US006205687B1

(12) United States Patent
Rocke

(10) Patent No.: US 6,205,687 B1
(45) Date of Patent: Mar. 27, 2001

(54) METHOD AND APPARATUS FOR DETERMINING A MATERIAL CONDITION

(75) Inventor: David J. Rocke, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/339,457

(22) Filed: Jun. 24, 1999

(51) Int. Cl.[7] ..... E02F 5/02
(52) U.S. Cl. ..... 37/348; 37/414; 701/50
(58) Field of Search ..... 37/348, 382; 172/2, 172/3, 4, 4.5, 7, 8, 9; 701/50; 414/699, 694

(56) References Cited

U.S. PATENT DOCUMENTS 5,446,980 * 9/1995 Rocke ..... 37/348
5,461,803 * 10/1995 Rocke ..... 37/443
5,493,798 * 2/1996 Rocke et al. ..... 37/348
5,528,843 6/1996 Rocke ..... 37/348
5,621,643 * 4/1997 Nakagami et al. ..... 364/424.07
5,682,312 * 10/1997 Rocke ..... 364/424.07
5,682,954 * 11/1997 Burns ..... 172/7
5,694,317 * 12/1997 Nakagami et al. ..... 364/424.07
5,826,666 * 10/1998 Tozawa et al. ..... 172/7
5,911,769 * 6/1999 Orbach et al. ..... 701/50
5,968,103 * 10/1999 Rocke ..... 701/50
5,974,352 * 10/1999 Shull ..... 701/50
6,064,933 * 5/2000 Rocke ..... 701/50

* cited by examiner

*Primary Examiner*—Victor Batson
(74) *Attorney, Agent, or Firm*—Clifton G. Green

(57) ABSTRACT

An apparatus for determining a condition indicative of a level of difficulty of excavation of a material engaged by a work machine having a work implement. A controller receives a first signal during a dig pass of the work machine, and determines a material condition indicative of a level of difficulty of excavation during the dig pass as a function of the first signal, and transmits an output signal during the dig pass as a function of the material condition.

40 Claims, 3 Drawing Sheets

METHOD AND APPARATUS FOR DETERMINING A MATERIAL CONDITION

TECHNICAL FIELD

This invention relates generally to determining the working conditions within which a work machine having a work implement operates, and more specifically, to determining a material condition indicative of a level of difficulty of excavation of the material that the work implement engages.

BACKGROUND ART

Conventional work machines, such as loaders and excavators, are becoming increasingly automated. Instead of a human operator manipulating various aspects of the work machine, such as raising and lowering the bucket, and backing the work machine out from a pile of material, electronic controllers control an increasing number of the functions of the work machine with minimal human input. It is increasingly desirable to automate the work cycle of a work machine to decrease operator fatigue, to more efficiently load the bucket, and to permit its use where conditions are unsuitable for a human operator.

Many of the functions of the work machine are dependent on the condition of the material that the work implement is moving or loading. For example, when a bucket loader loads a pile of loose or soft material, the bucket will typically fill more quickly than for a hard packed material.

Some automatic systems adjust the operating characteristics of the work machine depending on the material hardness. Typically these systems collect data during one work cycle, e.g., loading a bucket with material from a pile and backing away from the pile, and evaluating it. Based on the collected data, the system will adjust the characteristics of the work machine for the following work cycle.

These systems work well as long as the material conditions are uniform from one work cycle to the next. Material conditions, however, frequently vary between work cycles. For example, a bucket may be digging into a hill composed of two materials having different hardnesses, such as clay and sand. During the initial dig pass, the bucket may predominantly encounter the clay, while during the next pass, predominantly sand is encountered. Thus, the bucket will fill at different times for these two dig passes, and the operating characteristics for the first work cycle, e.g., the point at which the bucket is considered to be full, are not the optimum operating characteristics for the second work cycle.

DISCLOSURE OF THE INVENTION

The present invention provides apparatus and methods for determining a condition indicative of a level of difficulty of excavation of a material engaged by a work machine having a work implement. A controller receives a first signal during a dig pass of the work machine, and determines the material condition during the dig pass as a function of the first signal, and transmits an output signal during the dig pass as a function of the material condition.

BEST MODE FOR CARRYING OUT THE INVENTION

Figure 1:
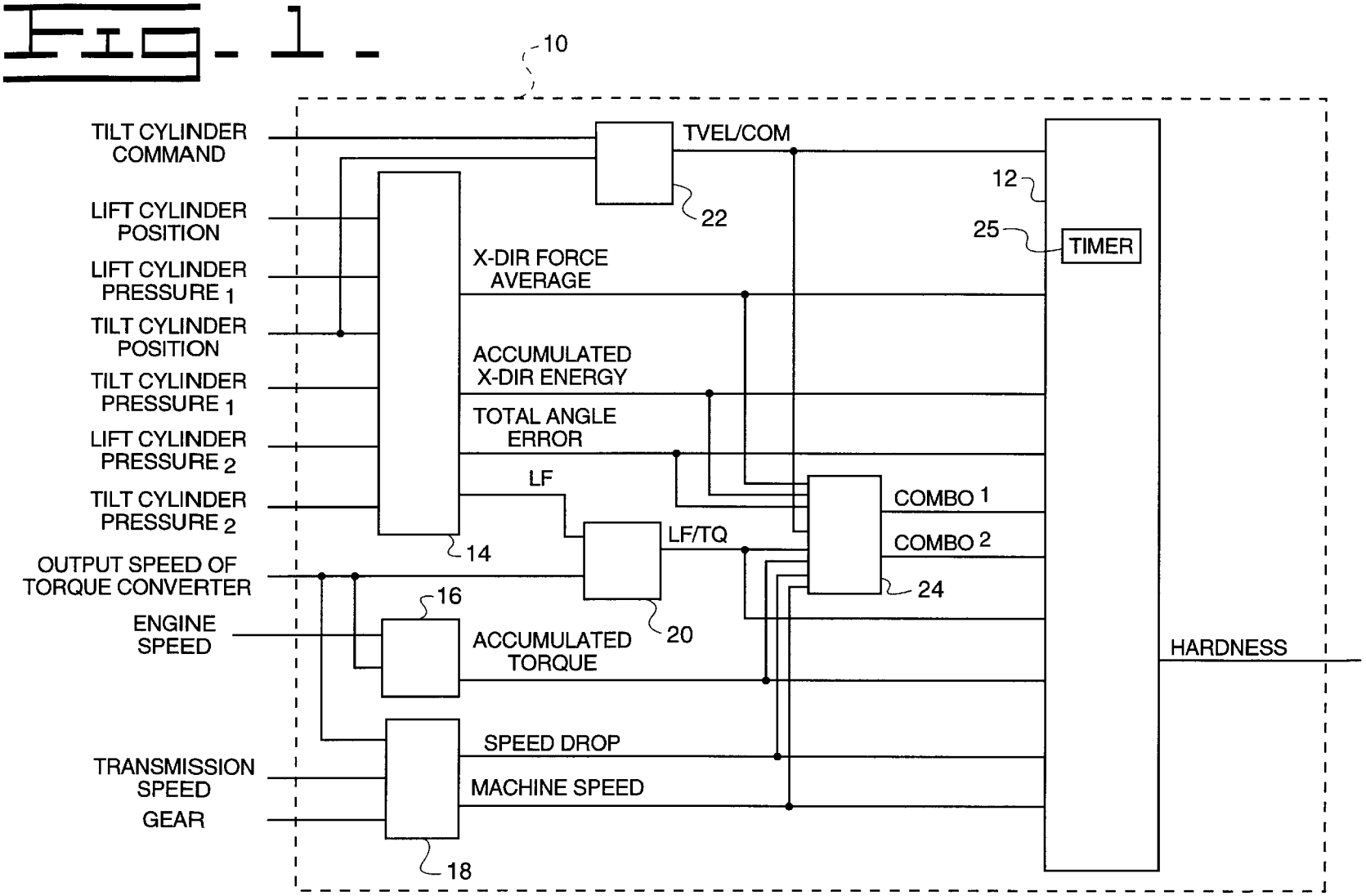
FIG. 1 is a block diagram of an apparatus for determining a condition indicative of a level of difficulty of excavation of a material engaged by a work implement of a work machine, for use with an automatic dig system.

FIG. 1 is a block diagram of an apparatus 10 for determining a condition indicative of a level of difficulty of excavation, such as hardness, of a material engaged by a work implement of a work machine, for use with an automatic dig system. The apparatus 10 comprises a controller 12 that receives at least one signal. The controller processes the at least one signal to determine the material condition indicative of a level of difficulty of excavation of a material being worked by a work implement of a work machine, and transmits an output signal that is a function of the material condition.

A variety of operating parameters of the work machine are indicative of material hardness. For example, a total angle error, an x-direction force average, an accumulated x-direction energy, an accumulated torque, a speed drop, and a combination of the total angle error, the x-direction force average, the accumulated x energy, the accumulated torque, and a speed drop all generally increase with an increasing material hardness. Similarly, a lift force/torque ratio, a tilt cylinder velocity/command ratio, a machine speed, and a combination of the lift force/torque ratio, the tilt cylinder velocity/command ratio, and the machine speed all generally decrease with an increasing material hardness. Each of these signals will be discussed in greater detail below. These parameters, however, are generally not directly available to the apparatus 10 from a particular sensor on the work machine. Instead, the parameters must be derived from other sources.

The apparatus 10 typically receives a lift cylinder position signal, a first lift cylinder pressure signal indicative of the fluid pressure on one side of a piston within the lift cylinder, a second lift cylinder pressure signal indicative of the fluid pressure on an other side of the piston within the lift cylinder, a tilt cylinder position signal, a first tilt cylinder pressure signal indicative of the fluid pressure on one side of a piston within the tilt cylinder, a second tilt cylinder pressure signal indicative of the fluid pressure on an other side of the piston within the tilt cylinder, an engine speed signal, a torque converter signal indicative of the rotational speed of a point of a torque converter, a transmission speed signal indicative of the rotational speed of a point of a transmission, a tilt cylinder command signal, and a gear signal. Each of these signals may be generated in ways known to those skilled in the art, such as by pressure, position, and rotational speed sensors.

In one embodiment, a first processing portion 14 determines an x-direction force average as a function of the lift cylinder position signal, the first and second lift cylinder pressure signals, the tilt cylinder position signal, and the first and second tilt cylinder pressure signals. The x-direction force average comprises the horizontal component of a force vector FV, discussed below, averaged over a predetermined sampling period, typically lasting from 1–4 seconds. The x-direction force is typically sampled from the moment of contact with the pile of material to the time when a bucket 52 begins to "rack", i.e., tilt back. For a medium sized wheel loader, such as the Caterpillar 980 series, the x-direction force average is typically measured from 0–1 seconds after contact with the pile. This time may vary, however, depending on the size and power of the work machine.

The x-direction force average may be calculated from the lift and tilt cylinder pressures and extensions, or by any other appropriate methods known to those skilled in the art. The first processing portion 14 calculates the x-direction force average, and transmits a processed signal, such as an x-direction force average signal ("X-DIR FORCE AVG"), that is a function of the x-direction force average. The x-direction force average signal may be generated and transmitted by any of a variety of appropriate ways known to those skilled in the art.

Generally, the harder the material, the greater the horizontal component of the force vector, i.e., the greater x-direction force, is. Thus, the x-direction force average is an indicator of material hardness.

In one embodiment, the first processing portion 14 determines an accumulated x-direction energy as a function of the lift cylinder position signal, the first and second lift cylinder pressure signals, the tilt cylinder position signal, and the first and second tilt cylinder pressure signals. Accumulated x-direction energy comprises the sum of the x-direction forces over a predetermined time multiplied by the distance of travel by the work machine 100 during the same predetermined time, typically the same timeframe used for sampling the x-direction force, discussed above, e.g., from 0–1 second after contact by the work machine 100 with the material for a medium sized wheel loader.

The first processing portion 14 calculates the accumulated x-direction energy and transmits a processed signal, such as an accumulated x-direction energy signal ("ACCUM X-DIR ENERGY"), that is a function of the accumulated x-direction energy. The accumulated x-direction energy signal may be generated and transmitted by any of a variety of appropriate ways known to those skilled in the art.

Generally, the harder the material, the greater the horizontal component of the force vector, ergo., the greater the accumulated x-direction energy, is. Thus, the accumulated x-direction energy is an indicator of material hardness.

Although the first processing portion 14 has been discussed above as determining the total angle error, the x-direction force average, and the accumulated x direction energy, each of these parameters need not be determined by a single processing portion. Instead, they may be calculated by separate processing portions (not shown), or some combination of multiple processing portions (not shown).

In one embodiment, the first processing portion 14 also generates a lift force signal ("LF") as a function of the lift cylinder pressure signals. The lift force signal is a function of the vertical force on the work implement. The vertical force, i.e., lift force, may be calculated using the lift cylinder position and pressure signals by ways known to those skilled in the art.

In one embodiment a second processing portion 16 determines an accumulated torque as a function of an engine speed signal and a torque converter output signal. The engine speed signal is a function of a rotational engine speed of an engine 56 (not shown) of the work machine 100, and the torque converter output signal is a function of the rotational speed of the output of a torque converter 60 (not shown). The torque of the wheels of the work machine is a function, typically a scaled ratio, of sensed values representative of the engine speed and torque converter output speed for an automatic transmission, and may be derived by any of several appropriate ways known to those skilled in the art, such as a look up table. The exact formula for determining wheel torque will vary with the geometry and configuration of the particular work machine.

The engine and torque converter output signals are each typically transmitted by a rotational speed sensor 70 (not shown), such as a magnetic pickup that counts the number of teeth on a gear that passes by in a given amount of time, although other appropriate methods known to those skilled in the art may also be used.

The accumulated torque comprises a sum of the torque values over a predetermined sampling period, typically lasting from 1–4 seconds, and once determined, the second processing portion 16 transmits a processed signal, such as an accumulated torque signal ("ACCUM TQ"), that is a function of the accumulated torque. The accumulated torque signal may be generated and transmitted by any of a variety of appropriate ways known to those skilled in the art. The accumulated torque is typically sampled and summed during the same timeframe used for sampling the x-direction force, discussed above, e.g., from 0–1 second after contact by the work machine 100 with the material for a medium sized wheel loader.

Generally, the harder the material, the more the material resists penetration by the work implement, and thus the greater the wheel torque. Thus, the accumulated torque is an indicator of material hardness.

In one embodiment, a third processing portion 18 determines a reduction in speed of the work machine 100 as a function of the torque converter output signal and the transmission speed signal. The transmission speed signal is a function of the rotational speed of a predetermined portion of the transmission, typically the output of the transmission or the output of the torque converter, and a known gear position (if needed).

The third processing portion 18 calculates the reduction in speed of the work machine over a predetermined period of time, typically 1–4 seconds, and transmits a processed signal, such as a speed drop signal ("SPEED DROP"), as a function of the reduction in speed. The relationship between the reduction in speed of the work machine and the torque converter and transmission speed signals will vary with the characteristics of the work machine, but may be determined by ways known to those skilled in the art. The speed drop signal may be generated and transmitted by any of a variety of appropriate ways known to those skilled in the art. The reduction in speed is typically determined during the same timeframe used for sampling the x-direction force, discussed above, e.g., from 0–1 second after contact by the work machine with the material for a medium sized wheel loader. Optionally, the third processing portion 18 may also receive a gear signal that is a function of a gear of the transmission of the work machine. Any change in gearing of the transmission is then detected, and the appropriate factor may be used to determine the speed of the work machine. Alternately, if no gear signal is used, the third processing portion 18 assumes the transmission is in a predetermined gear, such as first gear, and determines the speed of the work machine accordingly.

Generally, the harder the material, the more the material resists penetration by the work implement, and thus the greater the drop in speed of the work machine. Thus, the reduction in speed is an indicator of material hardness.

In one embodiment, the first signal processing portion 14 of the apparatus 10 receives the lift cylinder position signal, the first and second lift cylinder pressure signals, the tilt cylinder position signal, and the first and second tilt cylinder pressure signals. The first signal processing portion 14 determines the total angle error as a function of the lift cylinder position signal, the first and second lift cylinder pressure signals, the tilt cylinder position signal, and the first and second tilt cylinder pressure signals.

Figure 2:
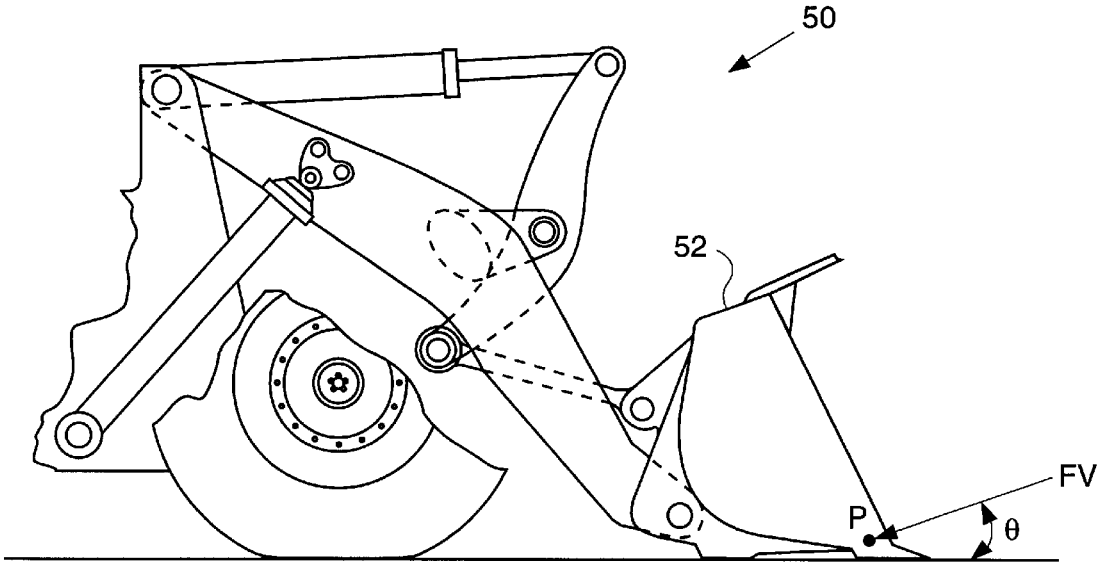
FIG. 2 is one embodiment of a forward portion of a work machine having a lift arm assembly that includes a bucket.

FIG. 2 is one embodiment of a forward portion of a work machine having a lift arm assembly 50 that includes the bucket 52. When the work implement, such as a bucket (not shown), engages, i.e., contacts, a pile of material (not shown), the material exerts a force vector FV on the bucket at some angle from the bucket floor or machine chassis. The direction and magnitude of the force vector FV represents digging resistance acting on a reference point P, and is treated as being equal and opposite to a force vector acting on the same point derived from wheel torque and lift and tilt cylinder pressures and extensions. The location of the reference point P is arbitrary, although typically defined as being approximately 4 inches back from a lower lip of the bucket 52. The calculation of the actual force vector FV involves translation of the several forces acting through the lift arm assembly 50 on the bucket 52 to the reference point P, and resolution into their component parts. The precise computations are dependent on the particular work machine 100 configuration, but are considered to be within the level of ordinary skill in the art and will not be set forth herein.

For a given bucket and work machine, an ideal angle exists which allows the work machine to be the most efficient in the dig pass. The ideal angle may be determined by experimentation, or be calculated based on a relationship with total accumulated energy at a point on the work implement, i.e., sum of the work in the x direction, the y direction, and rotational work. One such formula is $\Theta_i$=m*E+b, where $\Theta_i$ is the ideal force angle, m and b are constants that may be determined experimentally and typically vary with the condition of the material being dug, and E is the total accumulated energy. The ideal angle typically varies depending on the material condition, e.g., hardness, and may also depend on the portion of the dig cycle the work implement is in.

The difference between the actual force angle and the ideal force angle is an angle error. The sum of the angle error over time, e.g., a sampling period of 1–4 seconds, equals the total angle error. In a preferred embodiment, the total angle error is summed only when the angle error falls on the "harder" side of the ideal angle. Typically, an actual angle greater than the ideal angle indicates that the material is softer than expected, and an actual angle less than the ideal angle indicates that the material is harder than expected. The correlation of total angle error with material hardness is more pronounced if the angle errors are summed only when the actual angle is less than the ideal angle, and the angle errors are not summed when the actual angle is greater than the ideal angle.

The total angle error is typically determined only after significant penetration of the pile by the work machine has occurred, e.g., after the bucket 52 begins to "rack", or for some machines, when the lifting of the bucket pauses. For a medium sized wheel loader, such as the Caterpillar® 980 series, this timeframe is typically from 1–3 seconds after contact with the pile, although it may vary depending on the size and power of the work machine.

Generally, the harder the material, the greater the deviation of the actual force angle from ideal, i.e., the greater the total angle error. Thus, the total angle error is an indicator of material hardness. Exact calibration for this parameter and the other parameters discussed to material hardness is dependent on the characteristics of the particular work machine, and may be determined by formulas known to those skilled in the art, or by experimentation.

Referring back to FIG. 1, in one embodiment, the first processing portion 14 calculates the total angle error and transmits a processed signal, such as a total angle error signal ("TOTAL ANGLE ERROR"), that is a function of the lift cylinder position signal, the first and second lift cylinder pressure signals, the tilt cylinder position signal, and the first and second tilt cylinder pressure signals. The total angle error signal may be generated and transmitted by any of a variety of appropriate ways known to those skilled in the art.

In another embodiment of the apparatus 10 for determining material hardness, the first processing portion may receive only some of the signals mentioned above, such as the lift and tilt cylinder position signals, a lift cylinder pressure, and a tilt cylinder pressure. The total angle error may be estimated based on these signals alone, although the estimate will generally not be as accurate as the total angle error determined by the embodiment directly above.

In one embodiment, a fourth processing portion 20 determines a lift force/torque ratio as a function of the torque converter output signal and the lift force signal. The fourth processing portion 20 is coupled with the first processing portion to receive the lift force signal. The fourth processing portion 20 determines a lift force/torque ratio by dividing the lift force by the torque, and transmits a processed signal, such as a lift force/torque ratio signal ("LF/TQ"), that is a function of the lift force/torque ratio. The fourth processing portion 20 may use any of a variety of ways known to those skilled in the art to determine and transmit the lift force/torque ratio signal. The lift force/torque ratio is typically calculated during the same timeframe as the total angle error, e.g., 1–3 seconds after contact with the pile for a medium size wheel loader. For improved results, the data may be sampled for approximately 1–5 seconds, and an average value used for the calculations. The duration of the sampling time may depend on the application for which the hardness signal is being used, the wheel loader size, and whether the hardness indicator is being used during the dig pass, such as with an automated digging system, or only after a dig pass is completed, in which case a longer sampling time may be possible.

As mentioned above, the harder the material, the greater the torque needed to penetrate the pile. Generally, as the material hardness increases, the torque needed will increase at a greater rate than the lift force needed. Thus, the lower the lift force/torque ratio, the harder the material, and therefore the lift force/torque ratio is an indicator of material hardness.

In one embodiment a fifth processing portion 22 determines a tilt cylinder velocity/command ratio as a function of the tilt cylinder position signal and a tilt cylinder command signal. The tilt cylinder command signal comprises a signal sent from an electronic controller 72 (not shown) to a hydraulic system 74 (not shown) to control the position of the tilt cylinder 69 (not shown). Typically the tilt cylinder command signal has a variety of magnitudes corresponding to a desired rate of change of the position of the tilt cylinder. For example, when the tilt cylinder command signal comprises a current of 5 mA, the tilt cylinder may extend at a rate of 3 inches per second, while a current of 10 mA causes the tilt cylinder to extend at a rate of 6 inches per second. Other relationships between the rate of change of the position of tilt cylinder and the magnitude of the tilt cylinder command signal may also be used.

The fifth processing portion 22 determines a tilt cylinder velocity/command ratio as a function of the ratio of the velocity of the tilt cylinder, typically derived from the tilt cylinder position signal, and the magnitude of the tilt cylinder command, and transmits a processed signal, such as a tilt cylinder velocity/command ratio signal ("Tvel/COM"). The Tvel/COM signal may be generated and transmitted by any of a variety of appropriate ways known to those skilled in the art. The Tvel/COM ratio signal is typically calculated during the same timeframe as the total angle error, e.g., 1–3 seconds after contact with the pile for a medium size wheel loader. For improved results, the data may be sampled for approximately 1–5 seconds, and an average value used for the calculations. Again, the duration of the sampling may vary as described above.

Generally, the harder the material, the more the material resists the racking, i.e., tilting, of the bucket, which is controlled by the tilt cylinder 69. Thus, the tilt cylinder 69 will move at a higher velocity for a given command signal in soft material than for hard material, and therefore have a higher tilt cylinder velocity/command in the soft material. Thus, the tilt cylinder velocity/command ratio is an indicator of material hardness.

In one embodiment, the third processing portion 18 transmits a processed signal, such as a machine speed signal ("MACHINE SPEED"), as a function of the transmission speed and gear signals. The third processing portion 18 determines an average speed of the work machine 100 from the transmission speed and gear signals through any of a variety of appropriate ways known to those skilled in the art. The machine speed signal may be generated and transmitted by any of a variety of appropriate ways known to those skilled in the art. The average work machine speed is typically calculated during the same timeframe as the total angle error, e.g., 1–3 seconds after contact with the pile for a medium size wheel loader.

Generally, the harder the material, the more the work machine will be slowed by the pile of material, and the lower the average speed of the work machine will be. Thus, machine speed is an indicator of material hardness.

In one embodiment, a sixth processing portion 24 determines and transmits a processed signal, such as a first combination signal ("COMBO1"), as a function of the TOTAL ANGLE ERROR, Tvel/CMD, LF/TQ, and MACHINE SPEED signals. The sixth processing portion 24 is coupled with the first processing portion 14 to receive the total angle error signal, with the third processing portion 18 to receive the machine speed signal, to the fourth processing portion to receive the LF/TQ signal, and to the fifth processing portion to receive the Tvel/CMD signal. Typically the COMBO1 signal is a function of the average of the received signals, although other relationships may also be used. Because the total angle error generally increases with increasing material hardness, while the other factors all decrease, the sign of the total angle error may need to be reversed when determining the COMBO1 signal. Further, the magnitudes for each of the factors which make up the COMBO1 signal typically have widely varying maximum and minimum values. Thus, in order to allow for equal weighting of the components, each factor may be normalized, e.g., scaled, on a percentage of maximum basis.

Alternately, the total angle error signal may be normalized, and the normalized value used to determine the COMBO1 signal. The COMBO1 signal may be generated by any of a variety of appropriate ways known to those skilled in the art.

Because each of the components of the COMBO1 signal generally decrease as the hardness of the material increases, so too will the COMBO1 signal. Thus, the COMBO1 signal is an indicator of material hardness.

In an alternate embodiment, the sixth processing portion 24 may use only two of the Tvel/CMD, LF/TQ, and MACHINE SPEED signals to determine the combination signal.

In one embodiment, a processing portion, such as the sixth processing portion 24, determines and transmits a processed signal, such as a second combination signal ("COMBO2"), as a function of the x-direction force average signal, the accumulated x-direction energy signal, the accumulated torque signal, and the speed drop signal. The sixth processing portion 24 is coupled with the first processing portion 14 to receive the x-direction force average signal, and the accumulated x energy signal, with the second processing portion 16 to receive the accumulated torque signal, and with the third processing portion 18 to receive the speed drop signal. Typically the COMBO2 signal is a function of the average of the received signals, although other relationships may also be used. Further, the magnitudes for each of the factors which make up the COMBO2 signal typically have widely varying maximum and minimum values. Thus, in order to allow for equal weighting of the components, for example, each factor may be normalized, e.g., scaled, on a percentage of maximum basis. The COMBO2 signal may be generated by any of a variety of appropriate ways known to those skilled in the art.

Because each of the components of the COMBO2 signal generally increase as the hardness of the material increases, so too will the COMBO2 signal. Thus, the COMBO2 signal is an indicator of material hardness.

In an alternate embodiment, the sixth processing portion 24 may use fewer than the five signals discussed above to determine the combination signal. In one embodiment the controller 12 determines the material hardness as a function of how long it takes the machine to penetrate the pile a predetermined distance. Typically, the controller 12 includes a timer 25 that begins to count at the moment of pile contact. The moment of pile contact may be determined from the torque converter torque, for example. Typically the torque converter torque will gradually increase as the work machine accelerates towards the pile, and passes a predetermined threshold when the work machine has noticeably engaged the pile, e.g., shortly thereafter engaging the pile. Other methods for determining the moment of contact known to those skilled in the art may also be used.

The distance penetrated by the machine may be determined from the machine speed signal or its component signals. When the work machine has penetrated the predetermined distance, the controller 12 looks at the elapsed time since pile contact. The lower the elapsed time, the lower the material hardness, and vice versa. The precise scaling of hardness to elapsed time will vary with the characteristics of the work machine, and may be determined by experimentation.

The controller 12 is coupled with at least one of the first, second, third, fourth, fifth, and sixth processing sections, 14–24 to receive the appropriate signal or signals transmitted by the processing sections 14–24. The controller determines a material hardness as a function of the received signals. The controller may determine the material hardness through any of a variety of ways known to those skilled in the art, such as formulas or look up tables. The controller 12 transmits the output signal as a function of the material hardness, which may be used by the work machine in a variety of ways known to those skilled in the art to adjust the operating characteristics of the work machine.

Significantly, the reading of parameters, determination of material hardness, and the transmission of the output signal all occur within a single dig pass. This allows the work machine to adjust its operating characteristics in real time, and it need not rely on the material hardness determined in a preceding dig pass, which may be different from the material hardness of the current dig pass.

Although several of the parameters discussed above use a summing of the parameter over time, the parameter at an instant in time could also be used as an indicator of material hardness. This embodiment, however, is generally less accurate than the summing method due to potential variations in the characteristics of the pile of material from one location to the next, as well as because of spikes in the parameters that may occur at the instant of pile contact. In the latter situation, a reading taken at that moment in time could be vary drastically from readings taken during the rest of the dig pass, and result in a hardness determination that is grossly inaccurate.

Figure 3:
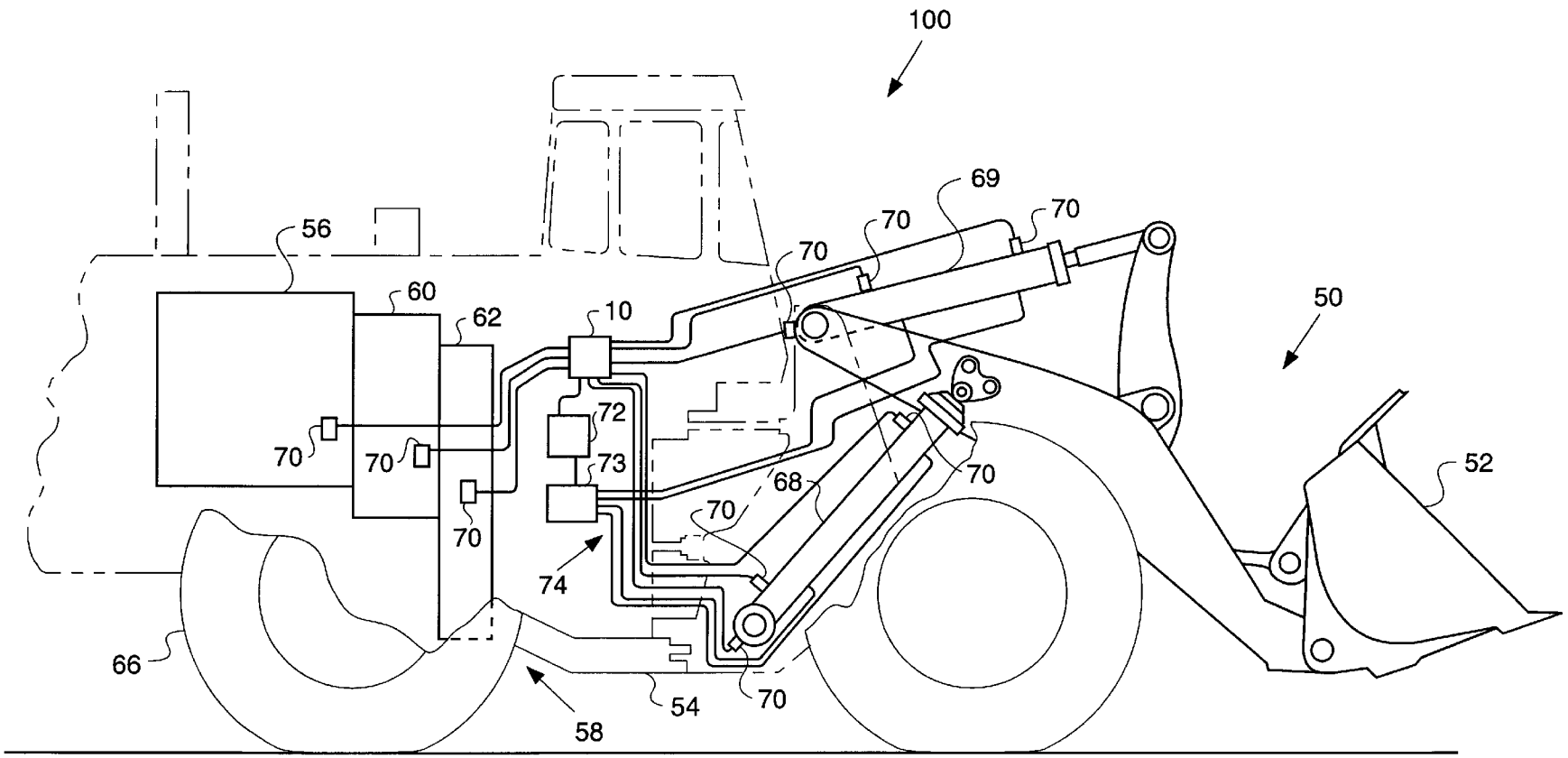
FIG. 3 is a side view and block diagram of one embodiment of a wheel loader having an automatic dig system and the apparatus for determining a condition indicative of a level of difficulty of excavation of a material of FIG. 1.

FIG. 3 is a side view and block diagram of one embodiment of a wheel loader 100 having an automatic dig system and the apparatus 10 for determining a hardness of a material. The wheel loader 100 includes a lift arm assembly 50 having a bucket 52, a chassis 54 coupled with the lift arm assembly 50, an engine 56 coupled with the chassis 54, a propulsion system 58 including a torque converter 60, a transmission 62, a drive shaft (not shown), and wheel 66 coupled with the engine 56, a lift hydraulic cylinder 68 coupled with the lift arm assembly 50 and the chassis 54, a tilt hydraulic cylinder 69 coupled with the lift arm assembly 50 and the chassis 54, a plurality of sensors 70 such as pressure, position, and rotational speed sensors coupled with the engine 56, propulsion system 58, and lift and tilt cylinders 68, 69, the apparatus 10 coupled with the plurality of sensors 70, an automatic dig controller 72 coupled with the apparatus 10, a hydraulic system controller 73 coupled with the automatic dig controller 72, and a hydraulic system 74 coupled with the hydraulic system controller 73 and the lift and tilt cylinders 68, 69.

The sensors 70 monitor a variety of parameters, such a position and pressures of the lift and tilt cylinders 68, 69, engine speed, output speed of the torque converter 60, transmission speed, and gear of the transmission. Each sensor 70 transmits a signal that is a function of the sensed parameter in response to sensing the parameter.

The apparatus 10 is coupled with the sensors 70 to receive each of the transmitted signals. The apparatus 10 functions as described above, and will not be repeated in the interest of brevity.

The automatic dig controller 72 is coupled with the apparatus 10 to receive the output signal, and adjusts any of a variety of appropriate operating parameters of the work machine, such as the parameters described above. The automatic dig controller 72 may adjust the operating parameters by any of a variety of appropriate ways known to those skilled in the art, such as sending a tilt cylinder command signal or a biasing signal to the hydraulic system controller 73. The hydraulic system controller 73 receives the tilt cylinder command signal or biasing signal, and actuates the tilt cylinder 69 in response to the tilt cylinder command or biasing signal in ways known to those skilled in the art.

In one embodiment, the automatic dig controller 72 varies its operating characteristics as a function of the output signal from the apparatus 10 to achieve a greater digging efficiency. For example, if the output signal indicates a relatively low material hardness, the automatic dig controller may send appropriate signals known to those skilled in the art to the hydraulic system controller to cause the hydraulic system controller 73 to increase the rate at which the bucket racks and the rate at which the bucket is lifted. This increase in rate reflects the shorter amount of time with which soft material fills the bucket 52 as compared to harder material. Thus, by increasing these rates, the dig pass is completed in a shorter time period. Other operating characteristics such as the lift force that indicates that penetration of the pile is complete may also be adjusted to correspond to the condition of the material being worked, i.e., the hardness. From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An apparatus for determining a material condition indicative of a level of difficulty of excavation for use with a work machine having a work implement, the apparatus comprising a controller operable to receive a first signal during a dig pass of the work machine, and to determine the material condition indicative of a level of difficulty of excavation during the dig pass as a function of the first signal, and to transmit an output signal during the dig pass as a function of the material condition.

2. The apparatus of claim 1 wherein the first signal comprises one of:

a total angle error signal;

an x-direction force average signal;

an accumulated x-direction energy signal;

an accumulated torque signal;

a speed drop signal;

a lift force/torque ratio signal;

a tilt cylinder velocity/command ratio signal;

a machine speed signal;

a gear signal; and a combination signal.

3. The apparatus of claim 1 wherein the controller is operable to receive at least one other signal during the dig pass, and is operable to transmit the output signal as a function of the first signal and the at least one other signal.

4. The apparatus of claim 3 wherein the at least one other signal respectively comprises at least one of:

a total angle error signal;

a x-direction force average signal;

a accumulated x-direction energy signal;

a accumulated torque signal;

a speed drop signal;

a lift force/torque ratio signal;

a tilt cylinder velocity/command ratio signal;

a machine speed signal;

a gear signal; and a combination signal;

the at least one other signal being a different signal than the first signal.

5. The apparatus of claim 3 wherein the controller includes a timer operable to receive the first signal and the at least one other signal, the first signal being a signal indicative of contact by the work implement with the material, and the at least one other signal being indicative of a distance traveled since contact with the material, the controller operable to transmit the material condition signal as a function of a time taken after contact to travel a predetermined distance.

6. The apparatus of claim 1 further comprising a signal processor, the signal processor operable to receive a plurality of signals and to generate the first signal as a function of the plurality of signals.

7. The apparatus of claim 6 wherein the first signal comprises one of a total angle error signal, an x-direction force average signal, and an accumulated x-direction energy signal, and the plurality of signals comprise:

a lift cylinder position signal;

a first lift cylinder pressure signal;

a tilt cylinder position signal; and a first tilt cylinder pressure signal.

8. The apparatus of claim 7 wherein the plurality of signals further comprise:

a second lift cylinder pressure signal; and a second tilt cylinder pressure signal.

9. The apparatus of claim 6 wherein the first signal comprises an accumulated torque signal, and the plurality of signals comprise:

an engine speed signal; and a torque converter output speed signal.

10. The apparatus of claim 6 wherein the first signal comprises one of a speed drop signal and a machine speed signal, and the plurality of signals comprise:

a torque converter output speed signal;

a transmission speed signal; and a gear signal.

11. The apparatus of claim 6 wherein the first signal comprises a lift force/torque ratio signal and the plurality of signals comprise:

a lift force signal; and a torque converter output speed signal.

12. The apparatus of claim 6 wherein the first signal comprises a tilt cylinder velocity/command ratio signal and the plurality of signals comprise:

a tilt cylinder command signal; and a tilt cylinder position signal.

13. The apparatus of claim 6 wherein the first signal comprises a combination signal, and the plurality of signals comprise:

a total angle error signal;

a lift force/torque ratio signal;

a tilt cylinder velocity/command ratio signal; and a machine speed signal.

14. The apparatus of claim 13 wherein the combination signal comprises an average of the total angle error signal, the lift force/torque ratio signal, the tilt cylinder velocity/command ratio signal, and the machine speed signal.

15. The apparatus of claim 6 wherein the first signal comprises a combination signal, and the plurality of signals comprise:

a x-direction force average signal;

an accumulated x-energy signal;

an accumulated torque signal; and a speed drop signal.

16. The apparatus of claim 15 wherein the combination signal comprises an average of the x-direction force average signal, the accumulated x-energy signal, the accumulated torque signal, and the speed drop signal.

17. The apparatus of claim 11, further comprising a second signal processor, the second signal processor operable to receive a second plurality of signals and to transmit the lift force signal as a function of the second plurality of signals.

18. The apparatus of claim 17 wherein the second plurality of signals comprise:

a lift cylinder position signal; and a first lift cylinder pressure signal.

19. The apparatus of claim 18 wherein the second plurality of signals further comprise a second lift cylinder pressure signal.

20. The apparatus of claim 6 wherein the signal processor receives the plurality of signals between a first predetermined time and a second predetermined time.

21. The apparatus of claim 20 wherein the first predetermined time comprises approximately 0 seconds after the work machine engages a pile of material and the second predetermined time comprises approximately 1 second after the work machine engages the pile of material.

22. The apparatus of claim 20 wherein the first predetermined time comprises approximately 0 seconds after the work machine engages a pile of material and the second predetermined time comprises a point in time at which initial penetration of the pile is substantially complete.

23. The apparatus of claim 20 wherein the first predetermined time comprises approximately 1 second after the work machine engages a pile of material and the second predetermined time comprises approximately 3 seconds after the work machine engages the pile of material.

24. The apparatus of claim 20 wherein the first predetermined time comprises one of an approximate point in time wherein the bucket begins to tilt back after engaging the pile and an approximate point in time when the lift cylinder makes a first pause after contact with the pile.

25. The apparatus of claim 17 wherein the signal processor receives the second plurality of signals between a third predetermined time and a fourth predetermined time.

26. The apparatus of claim 25 wherein the third predetermined time comprises approximately 1 second after the work machine engages a pile of material and the fourth predetermined time comprises approximately 3 seconds after the work machine engages the pile of material.

27. The apparatus of claim 1 wherein the material condition comprises a hardness.

28. An apparatus for determining a material condition indicative of a level of difficulty of excavation for use with a work machine having a torque converter, comprising:

a controller operable to receive a gear signal, a torque converter output speed signal, a tilt cylinder position signal, a tilt cylinder command signal, and at least one of an engine speed signal and a transmission speed signal, each signal being received during a dig pass, the controller operable to determine an accumulated torque as a function of the engine speed signal and the torque converter output speed signal, to determine a speed drop as a function of the transmission output signal, to determine a tilt cylinder velocity/command ratio as a function of the tilt cylinder position signal and the tilt cylinder command signal, and to determine a machine speed as a function of the gear signal and at least one of the engine speed signal and the transmission speed signal, the controller further operable to determine a material condition indicative of a level of difficulty of excavation during the dig pass as a function of the accumulated torque, the speed drop, the tilt cylinder/command ratio, and the machine speed, and to transmit a material condition signal as a function of the material condition.

29. An operating machine, comprising:

a chassis;

an engine coupled with the chassis, the engine operable to generate a propelling force;

a propulsion system coupled with the engine to receive the propelling force and operable to propel the operating machine as a function of receiving the propelling force;

a work implement coupled with the chassis;

a hydraulic system including a hydraulic cylinder, the hydraulic system coupled with the work implement and the chassis, the hydraulic system operable to move the work implement;

a first plurality of sensors operable to determine respective first parameters during a dig pass, and to transmit respective condition signals during the dig pass as a function of the respective parameters;

at least one signal processor, each signal processor coupled with a respective second plurality of sensors to receive respective condition signals, each signal processor operable to generate a respective processed signal as a function of the respective condition signals;

a first controller coupled with the at least one signal processor to receive the respective processed signal, the controller operable to determine a material condition indicative of a level of difficulty of excavation during the dig pass as a function of the respective processed signal, and to transmit an output signal during the dig pass as a function of the material condition; and a second controller coupled with the first controller to receive the output signal, the first controller operable to adjust an operating characteristic of the work machine during the dig pass as a function of receiving the output signal.

30. The apparatus of claim 29 wherein the respective condition signals comprise a respective one of:

a total angle error signal;

a x-direction force average signal;

an accumulated x-direction energy signal;

an accumulated torque signal;

a speed drop signal;

a lift force/torque ratio signal;

a tilt cylinder velocity/command ratio signal;

a machine speed signal;

a gear signal; and a combination signal.

31. A method for determining a material condition indicative of a level of difficulty of excavation in real time, comprising:

determining at least one parameter during a dig pass;

determining the material condition during the dig pass as a function of the at least one parameter; and transmitting a material condition signal during the dig pass as a function of the material condition.

32. The method of claim 31 wherein the at least one parameter comprises at least one of:

a total angle error;

a x-direction force average;

an accumulated x-direction energy;

an accumulated torque;

a speed drop;

a lift force/torque ratio;

a tilt cylinder velocity/command ratio;

a machine speed;

a combination of the total angle error, the lift force/torque ratio, the tilt cylinder velocity/command ratio, and the machine speed; and a combination of the x-direction force average, the accumulated x-direction energy, the accumulated torque, and the speed drop.

33. The method of claim 31, further comprising adjusting an operating characteristic of a work machine as a function of the material condition signal.

34. The method of claim 31 wherein determining the at least one parameter during the dig pass comprises:

sensing a plurality of conditions of the work machine; and calculating the at least one parameter as a function of at least some of the plurality of conditions.

35. The method of claim 34 wherein at least one parameter is determined at a time between approximately 0–1 seconds after a dig pass begins.

36. The method of claim 34 wherein at least one parameter is determined at a time between approximately 1–3 seconds after a dig pass begins.

37. The method of claim 32 wherein the combination of the total angle error, the lift force/torque ratio, the tilt cylinder velocity/command and the machine speed comprises an average of the total angle error, the lift force/torque ratio, the tilt cylinder velocity/command ratio, and the machine speed.

38. The method of claim 31 wherein determining the at least one parameter comprises:

sensing a first operating characteristic of a work machine;

sensing a second operating characteristic of the work machine; and calculating the at least one parameter as a function of the first and second operating characteristics.

39. The method of claim 38 wherein one of the first and second operating characteristics comprises one of:

a lift cylinder position;

a first lift cylinder pressure;

a tilt cylinder position; and a first tilt cylinder pressure;

a second lift cylinder pressure;

a second tilt cylinder pressure;

an engine speed;

a torque converter output speed;

a transmission speed;

a gear; and a tilt cylinder command.

40. The method of claim 39 wherein the other of the first and second operating characteristics comprises another of:

the lift cylinder position;

the first lift cylinder pressure;

the tilt cylinder position; and the first tilt cylinder pressure;

the second lift cylinder pressure;

the second tilt cylinder pressure;

the engine speed;

the torque converter output speed;

the transmission speed;

the gear;

the tilt cylinder command; and the second operating characteristic being a different operating characteristic than the first operating characteristic.

* * * * *